United States Patent [19]

Adin et al.

[11] Patent Number: 4,469,773

[45] Date of Patent: Sep. 4, 1984

[54] CARBAMOYLOXY SUBSTITUTED COUPLERS IN A PHOTOTHERMOGRAPHIC ELEMENT AND PROCESS

[75] Inventors: Anthony Adin; Csaba A. Kovacs; Delwyn E. Machiele, all of Rochester, N.Y.

[73] Assignee: Eastman Kodak Company, Rochester, N.Y.

[21] Appl. No.: 504,754

[22] Filed: Jun. 15, 1983

[51] Int. Cl.[3] ..... G03C 1/02

[52] U.S. Cl. ..... 430/222; 430/553; 430/555; 430/557; 430/617; 430/618; 430/619; 430/620; 430/212; 430/936; 430/341; 430/351; 430/502; 430/505

[58] Field of Search ..... 430/553, 555, 557, 617, 430/618, 619, 620, 222, 212, 936, 341, 351, 502, 505

[56] References Cited

U.S. PATENT DOCUMENTS

| | | | |
|---|---|---|---|
| 3,457,075 | 7/1969 | Morgan . | |
| 3,761,270 | 9/1973 | deMauriac . | |
| 4,191,574 | 3/1980 | Endo et al. | 430/555 |
| 4,241,172 | 12/1980 | Okaniwa et al. | 430/557 |
| 4,264,725 | 4/1981 | Reeves . | |
| 4,299,914 | 11/1981 | Fujimatsu et al. | 430/553 |

FOREIGN PATENT DOCUMENTS

| | | |
|---|---|---|
| WO80/01322 | 6/1980 | PCT Int'l Appl. . |
| 2012445 | 7/1979 | United Kingdom . |

OTHER PUBLICATIONS

"The Theory of the Photographic Process," Edited by T. H. James, 4th Edition, 1977, pp. 353–361.

Research Disclosure, Dec. 1978, Item No. 17643.
Research Disclosure, Jun. 1978, Item No. 17029.
Research Disclosure, Jan. 1983, Item No. 22534.
Research Disclosure, Oct. 1974, Item No. 12617.
Research Disclosure, Apr. 1978, Item No. 16845.

*Primary Examiner*—Won H. Louie
*Attorney, Agent, or Firm*—Richard E. Knapp

[57] ABSTRACT

A coupler containing in the coupling position a carbamoyloxy group upon oxidative coupling, releases a carbamic acid fragment that, in turn, is capable of thermally releasing ammonia or an amine. Such a carbamoyloxy substituted coupler and carbamic acid fragment are useful in imaging such as in photothermography and thermography. Ammonia or an amine released from the carbamic acid fragment enables imaging in imaging materials that are responsive to ammonia or an amine. The carbamoyloxy substituted coupler also generally is a dye-forming coupler that reacts with the oxidized form of a color developing agent to form a dye. An image is produced in an exposed photothermographic material comprising the carbamoyloxy substituted coupler by thermal development. An image is produced in a thermographic material comprising the carbamoyloxy substituted coupler and a color developing agent by imagewise heating the thermographic material.

34 Claims, No Drawings

CARBAMOYLOXY SUBSTITUTED COUPLERS IN A PHOTOTHERMOGRAPHIC ELEMENT AND PROCESS

BACKGROUND OF THE INVENTION

1. Field of the Invention

This invention relates to use in a photothermographic or thermographic material of a coupler containing in the coupling position a carbamoyloxy group

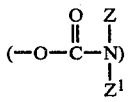

that upon oxidative coupling with the a silver halide developing agent, releases a carbamic acid fragment. The carbamic acid fragment, in turn, is capable of thermally releasing ammonia or an amine. The invention also relates to the use of such a coupler with imaging materials that are responsive to ammonia or an amine released upon heating.

2. Description of the State of the Art

Photographic materials for producing silver images and dye images are known. The dye image in such materials is generally produced by a coupling reaction in which a developing agent is oxidized upon development of photographic silver halide in the material, followed by reaction of the resulting oxidized form of the developing agent with a coupling agent to produce a dye image. It has been desirable to provide a means for enhancing an image, that is the silver image or dye image, other than by addition to the photographic material of more coupler, more developing agent and more photographic silver halide. The means for image enhancement according to the invention does not require higher concentrations of such reactants than are otherwise useful.

Couplers which react with the oxidized form of silver halide developing agents are known. Examples of such couplers are described in, for instance, "The Theory of the Photographic Process" edited by T. H. James, 4th Edition, 1977, pages 353-361 and U.S. Pat. No. 3,761,270. None of these couplers in photothermographic or thermographic imaging involve a carbamoyloxy substituent that, upon oxidative coupling with the oxidized form of a developing agent, releases a carbamic acid fragment that, in turn, is capable of thermally releasing ammonia or an amine. The couplers lack the capability of thermally releasing ammonia or an amine.

Imaging compounds that are responsive to or activated by ammonia or an amine are also known. Examples of such imaging compounds are described in, for instance, published patent application WO 80/01322 published June 26, 1980. In such an imaging material phthalaldehyde is an imaging component that forms a dye in response to action by ammonia or an amine released from a cobalt(III) complex. None of these imaging materials contain a coupler, such as a dye-forming coupler, comprising a carbamoyloxy group that is capable of aiding or augmenting imaging upon thermal processing.

SUMMARY OF THE INVENTION

It has been found according to the invention that in a coupler, a carbamoyloxy substituent

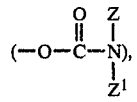

in a coupling position, enables release of a carbamic acid fragment when the coupler oxidatively couples with the oxidized form of a silver halide developing agent. The carbamic acid fragment, in turn, is capable of thermally releasing ammonia or an amine. Preferably the coupler is represented by the formula:

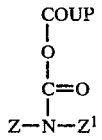

wherein

COUP represents a coupling moiety that is capable of oxidative coupling with the oxidized form of a silver halide developing agent; and Z and $Z^1$ are individually hydrogen; alkyl, such as containing 1 to 25 carbon atoms, for example methyl, ethyl, propyl, butyl decyl and eicosyl; aryl, such as containing 6 to 25 carbon atoms, for example phenyl and tolyl; or, together are atoms selected from the group consisting of carbon, hydrogen, nitrogen and oxygen atoms necessary to complete a 5 or 6 member heterocyclic group, such as morpholino, piperazino, piperidino, pyrazino, pyrimidino, and pyrrolidino. Following oxidative coupling with the coupler, ammonia or an amine is released from the resulting carbamic acid fragment by heating the carbamic acid fragment to a temperature within the range of about 100° C. to about 200° C. The carbamoyloxy substituent

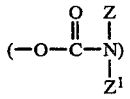

is in a coupling position on the COUP moiety.

A dye image, preferably a dye image that enhances a silver image or dye image, is produced according to the invention by means of a photothermographic material comprising, in reactive association, preferably in a binder, photographic silver halide, a silver halide developing agent and a coupler that is capable of oxidative coupling with the oxidized form of the developing agent, wherein the coupler is a carbamoyloxy substituted coupler that, upon oxidative coupling with the oxidized form of the developing agent, released a carbamic acid fragment that, in turn, is capable of thermally releasing ammonia or an amine. The dye image absorbs radiation in the ultraviolet, visible or infrared regions of the electromagnetic spectrum.

A preferred photothermographic material according to the invention comprises at least one image forming material which generates an image at processing temperature in response to the presence of ammonia or an amine from the carbamic acid fragment. For example, the photothermographic material or thermographic material optionally comprises an aromatic dialdehyde, such as o-phthalaldehyde, capable of reacting with ammonia or an amine generated from the carbamic acid fragment to form a dye. The photothermographic material or thermographic material also optionally comprises a reducible cobalt(III) amine complex. An advantage of such a photothermographic material comprising photographic silver halide and an image forming material that generates an image in response to the presence of ammonia or an amine is that the photographic silver halide is useful for its high degree of photosensitivity and the image forming material that generates an image in response to the presence of ammonia or an amine, such as a reducible cobalt(III) complex, provides desired image discrimination and image density enhancement.

An image in a photothermographic material according to the invention is developed by heating the exposed photothermographic material to processing temperature, such as a temperature within the range of about 100° C. to about 200° C., until an image is developed. An image in a thermographic material according to the invention is produced by imagewise heating the thermographic material to an imaging temperature within the range of about 100° C. to about 200° C. until an image is produced.

DETAILED DESCRIPTION OF THE INVENTION

A dye image, preferably a dye image that enhances a silver image, is produced according to the invention by means of a photothermographic material or thermographic material comprising the carbamoyloxy substituted couplers that are capable of releasing a carbamic acid fragment that in turn is capable of thermally releasing ammonia or an amine. The dye image absorbs radiation in the ultraviolet or visible regions of the electromagnetic spectrum. The carbamoyloxy substituted coupler in the photothermographic material according to the invention aids image formation by oxidatively coupling at processing temperature with the oxidized form of a reducing agent, preferably the oxidized form of a silver halide developing agent. This oxidative coupling reaction can form an image dye that is visible in the visible region of the electromagnetic spectrum. Optionally, the oxidative coupling reaction can form a dye that absorbs in the ultraviolet region or infrared region of the electromagnetic spectrum. The oxidative coupling reaction must not adversely affect the release of the thermally decomposable carbamic acid fragment resulting from the carbamoyloxy substituted coupler. The dye formed by the oxidative coupling reaction can enhance or complement the silver image formed in the photothermographic material and/or the dye image formed in the ammonia or amine responsive image-forming material.

A preferred photothermographic material according to the invention comprises at least one image-forming material that generates an image dye at processing temperature in response to the presence of ammonia or an amine from the carbamic acid fragment. For example, the photothermographic material optionally comprises an aromatic 1,2-dialdehyde, such as ortho-phthalaldehyde, capable of reacting with ammonia or an amine generated from the thermal decomposition of the carbamic acid fragment.

Many carbamoyloxy substituted couplers are useful in a photothermographic material according to the invention. Combinations of carbamoyloxy substituted couplers are also useful. The coupling moiety of the coupler can comprise substituent groups which do not adversely affect the desired oxidative coupling reaction and release of the carbamoyloxy moiety or the thermal release of ammonia or amine from the carbamic acid fragment. The substituent groups on the coupler moiety should not adversely affect the capability of the carbamoyloxy group from being released upon oxidative coupling.

Examples of useful carbamoyloxy substituted couplers are as follows:

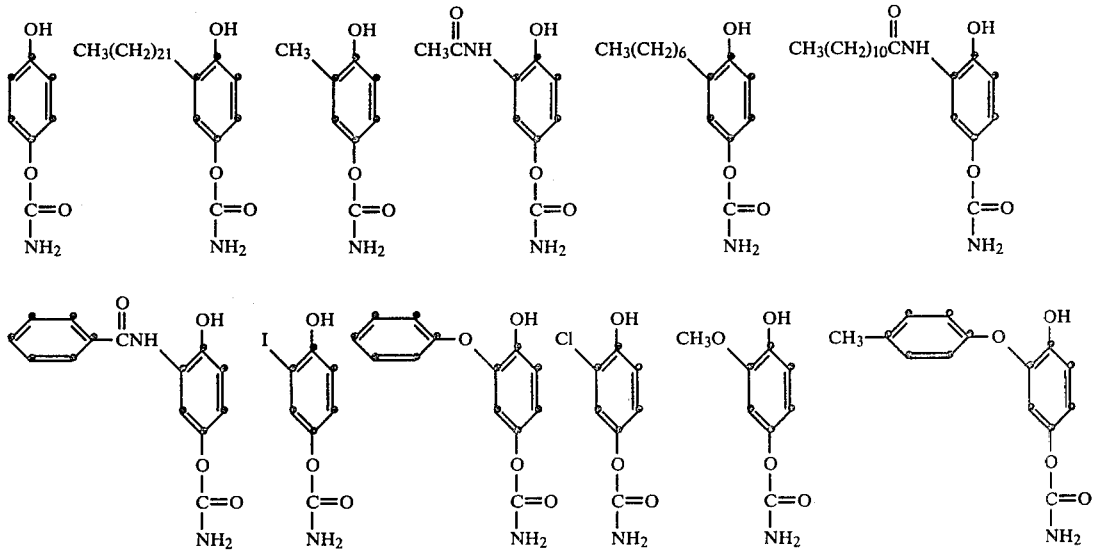

-continued
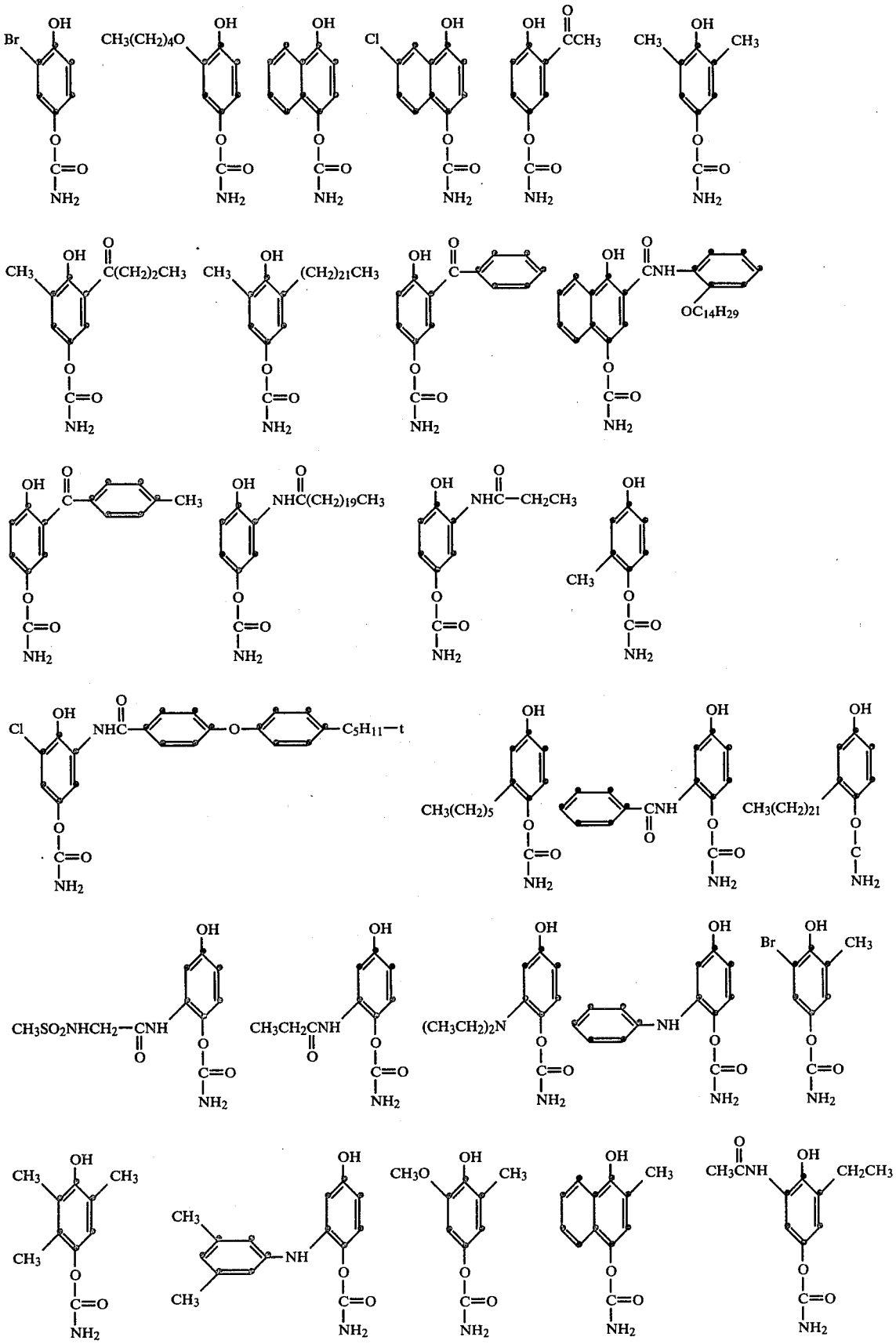

-continued
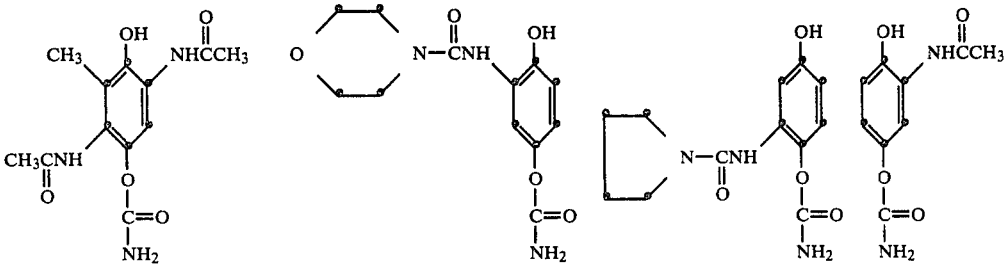
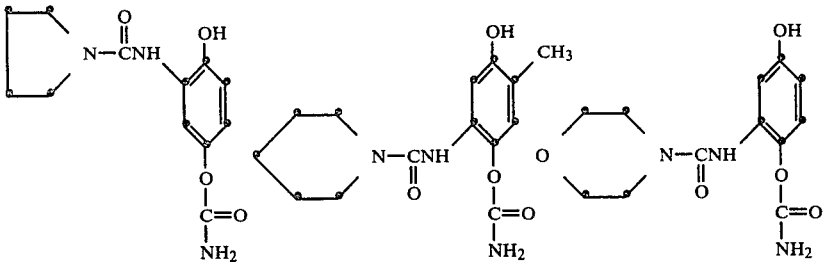
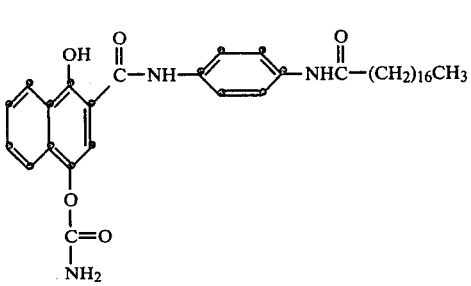
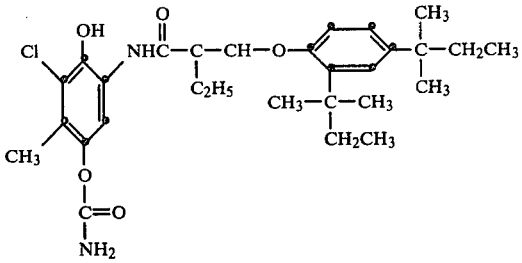
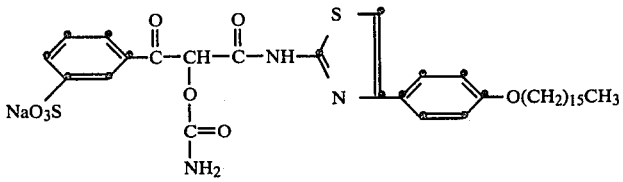
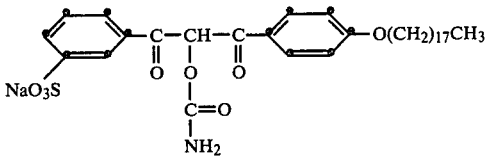
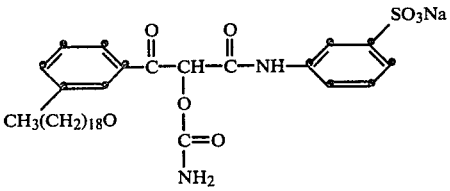
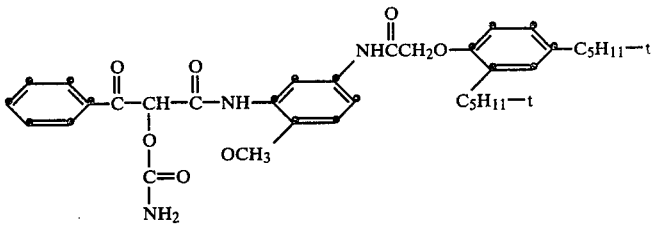
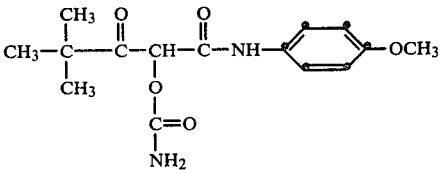
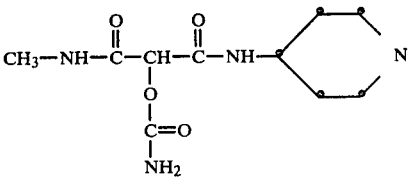
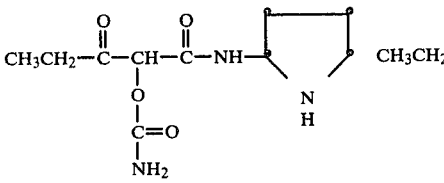
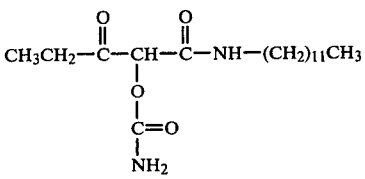
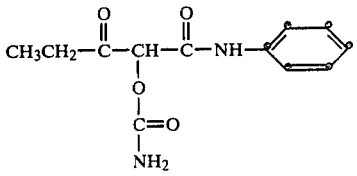

-continued
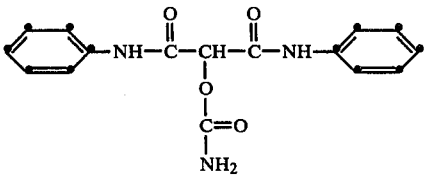
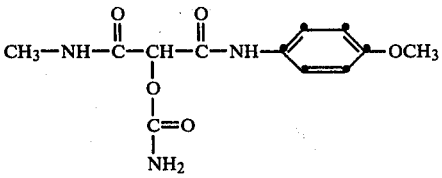
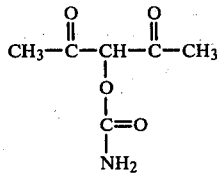
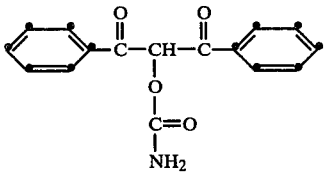
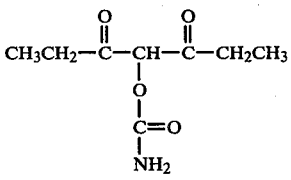
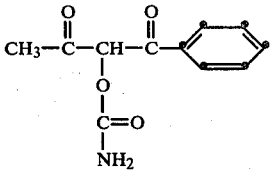
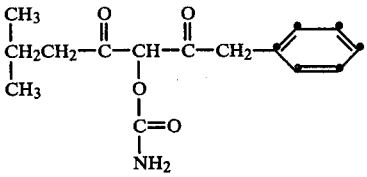
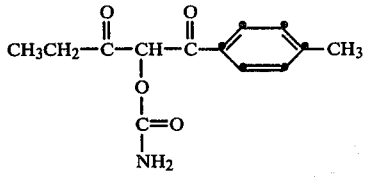
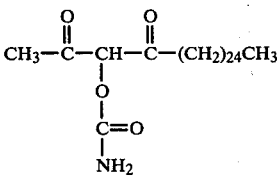
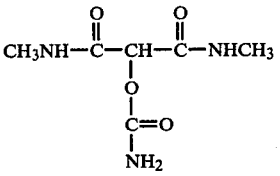
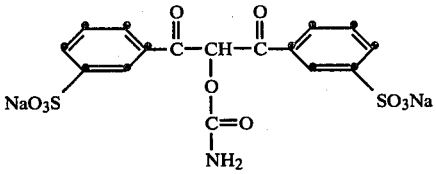
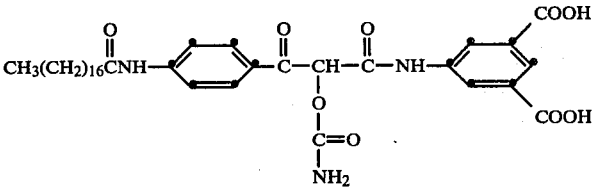
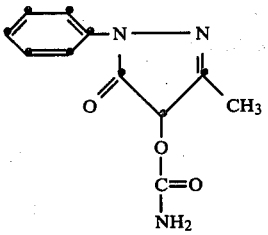
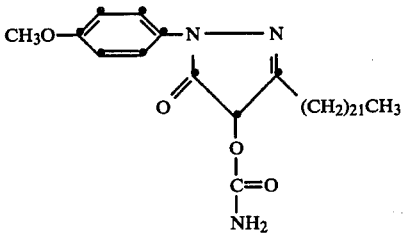
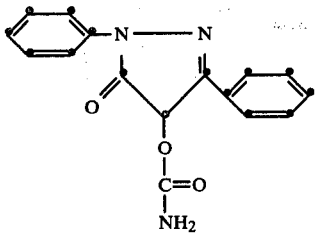
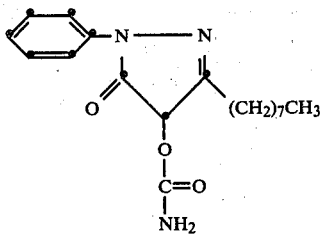
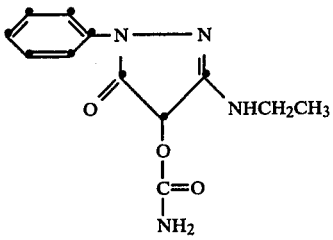
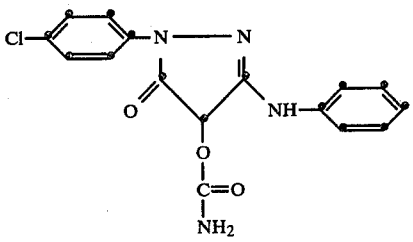

-continued
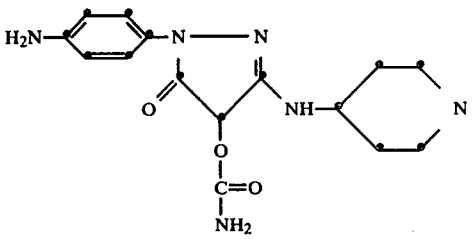
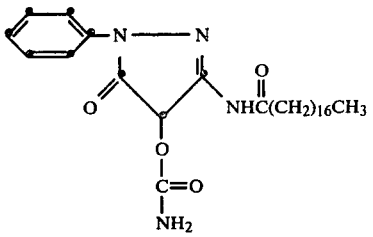
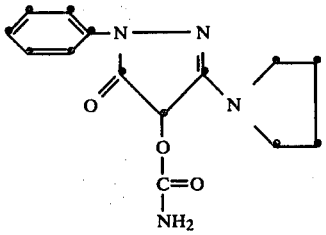
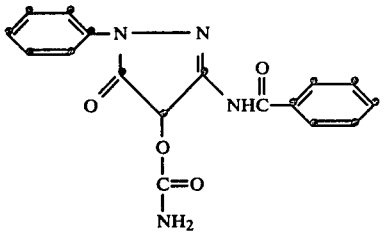
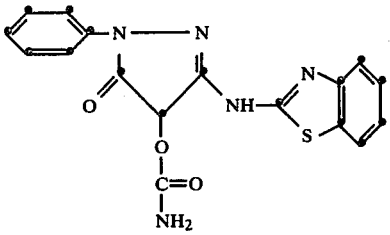
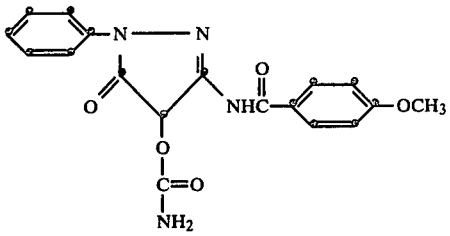
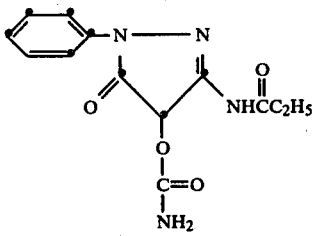
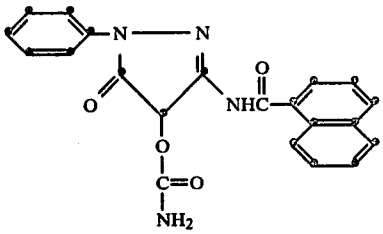
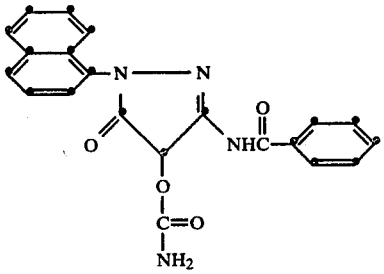
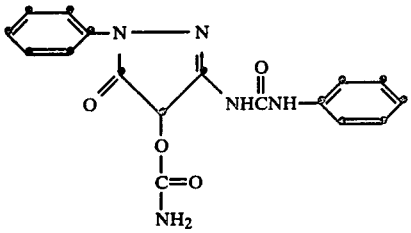
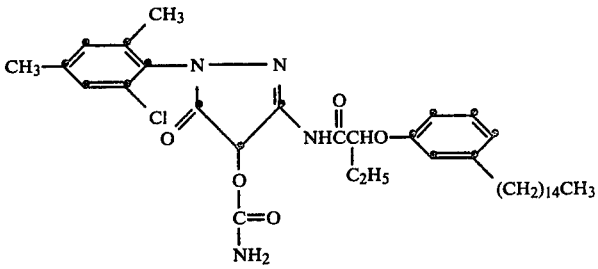
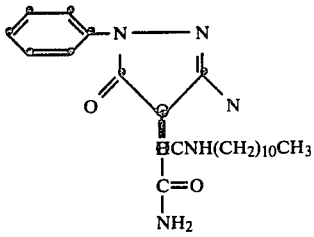

-continued
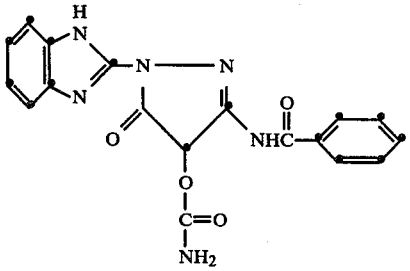
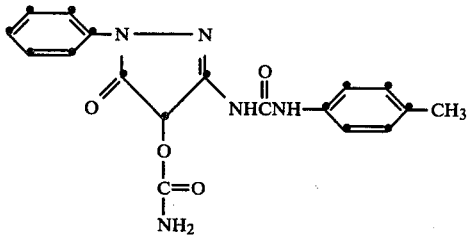
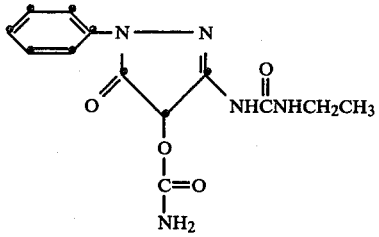
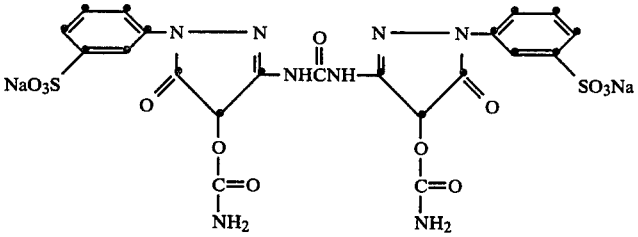
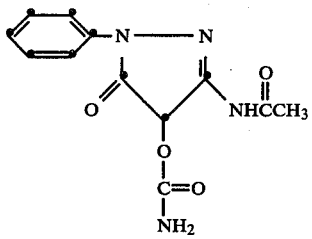
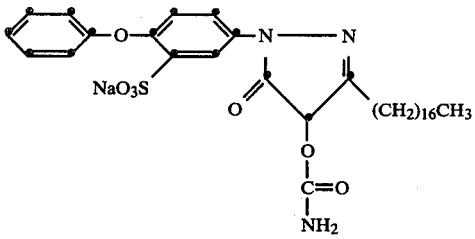
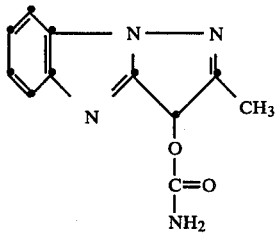
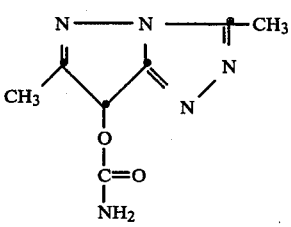
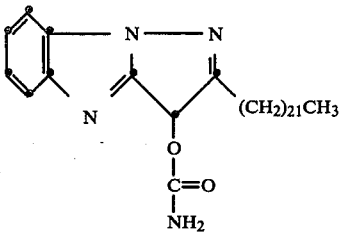
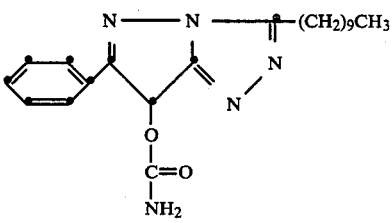
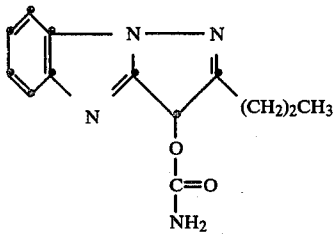
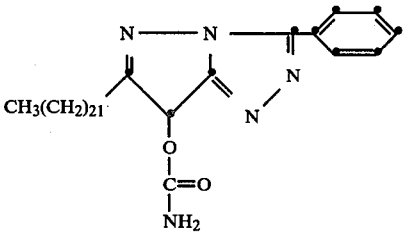
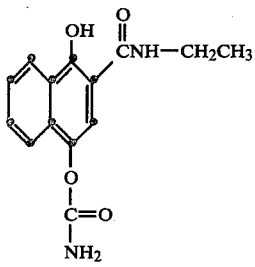
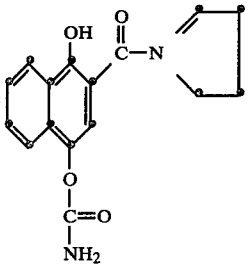
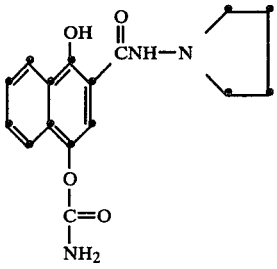
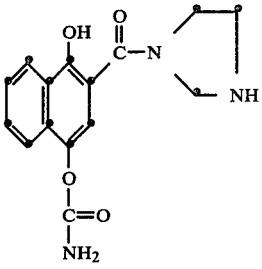

-continued

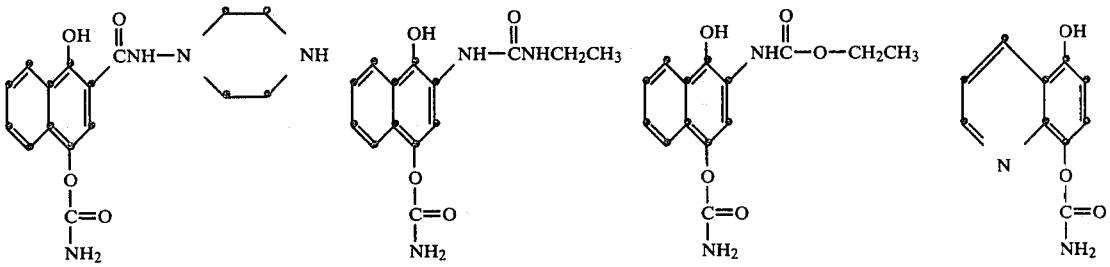

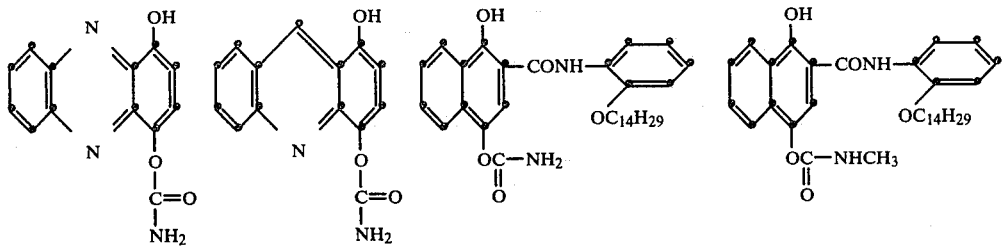

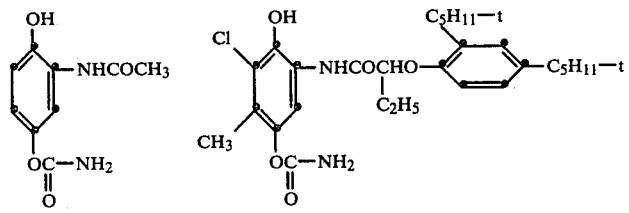

The term "thermally releasing", such as thermally releasing ammonia or an amine, herein means that the carbamic acid fragment separates into ammonia or an amine and other moieties by means of heat applied to the carbamic acid fragment.

The terms "alkyl" and "aryl" herein include unsubstituted alkyl, such as unsubstituted methyl, ethyl, propyl or butyl, and unsubstituted aryl, such as unsubstituted phenyl. The terms also include alkyl and aryl that are substituted by groups which do not adversely affect the desired properties of the photothermographic material or thermographic material, the carbamoyloxy substituted coupler, or the carbamic acid fragment released upon oxidation. Examples of useful substituted alkyl groups include alkyl substituted by alkoxy, carboxamido, methoxy or methylsulfonamido. Examples of useful substituted aryl include methoxyphenyl, 2,4,6-triisopropylphenyl and tolyl. Aryl herein also includes alkaryl such as benzyl, 2,4,6-triisopropylphenyl, 2,4,6-triethylphenyl and xylyl.

The term "COUP" herein means a coupling moiety that is capable of oxidative coupling with the oxidized form of a reducing agent, preferably the oxidized form of a silver halide developing agent, such as the oxidized form of a phenylenediamine silver halide developing agent. The "COUP" moiety can form a dye which is visible in the ultraviolet, visible or infrared regions of the electromagnetic spectrum. An optimum "COUP" moiety according to the invention will depend upon such factors as the desired image, particular photothermographic and thermographic material, processing conditions, particular photographic silver halide in the photothermographic material, other components in the photothermographic or thermographic material and the particular reducing agent, such as the particular phenylenediamine silver halide developing agent.

The term carbamoyloxy group herein means a group represented by the formula:

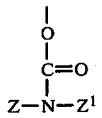

wherein Z and $Z^1$ are as defined. The carbamoyloxy group is released from the coupler upon oxidative coupling. The carbamoyloxy group is capable of releasing a carbamic acid fragment that, in turn, is capable of thermally releasing ammonia or an amine. An optimum carbamoyloxy group herein depends upon such factors as the desired image, particular photothermographic or thermographic material, processing conditions, particular photographic silver halide in the photographic material, other components in the photothermographic or thermographic material.

An example of a carbamoyloxy substituted coupler according to the invention is a cyan dye-forming coupler containing a carbamoyloxy substituent in the coupling position. An example of such a cyan dye-forming coupler is a compound represented by the formula:

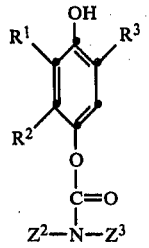

wherein $R^1$, $R^2$ and $R^3$ are the same or different and individually represent hydrogen, alkyl, such as alkyl containing 1 to 25 carbon atoms, for example methyl, ethyl, propyl, butyl, pentyl, decyl and eicosyl; halo, such as chloro, bromo and iodo; aryloxy, such as phenoxy; alkoxy, such as alkoxy containing 1 to 25 carbon atoms, for example methoxy, ethoxy, propoxy, and eicosyloxy; alkylcarbamoyl

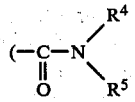

wherein at least one of $R^4$ and $R^5$ is alkyl), such as ethylcarbamoyl and butylcarbamoyl; arylcarbamoyl

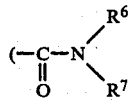

wherein at least one of $R^6$ and $R^7$ is aryl), such as phenylcarbamoyl and naphthylcarbamoyl; and heterylcarbamoyl

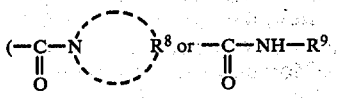

wherein $R^8$ represents the atoms necessary to complete a heterocyclic group, preferably a 5 or 6 member heterocyclic group, for example an imidazolino or pyrrolidino group, and $R^9$ represents a heterocyclic group, preferably a 5 or 6 member heterocyclic group, such as a pyrrolidino, piperizino, piperidino, imidazolino or pyrimidino group); carboxamido

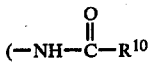

wherein $R^{10}$ is alkyl, such as alkyl containing 1 to 25 carbon atoms, for example methyl, ethyl, propyl, decyl and eicosyl, and aryl, such as phenyl), for example, acetamido and benzamido; ureido

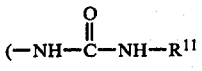

wherein $R^{11}$ is a hydrogen, alkyl, for example methyl, ethyl and propyl, or aryl, such as phenyl);

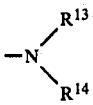

wherein $R^{13}$ and $R^{14}$ are individually alkyl, such as alkyl containing 1 to 25 carbon atoms, such as methyl, ethyl, propyl, butyl and eicosyl), for example, ethylamino and i-propylamino; or $R^1$ together with $R^2$ represents the atoms necessary to complete a carbocyclic group or heterocyclic group, preferably a 5 or 6 member heterocyclic group, to form such ring systems, as naphthalene and quinoline; and, $Z^2$ and $Z^3$ are individually hydrogen, alkyl, preferably alkyl containing 1 to 6 carbon atoms, such as methyl, ethyl, propyl and butyl; aryl, preferably aryl containing 6 to 10 carbon atoms, or together are the atoms selected from the group consisting of carbon, hydrogen, nitrogen and oxygen atoms necessary to complete a 5 or 6 member heterocyclic group, such as morpholino, pyrrolidino and imidazolino.

Another class of carbamoyloxy substituted couplers is the class of active methylene couplers containing a carbamoyloxy group in the coupling position. Such active methylene couplers are represented by the formula:

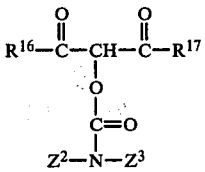

wherein $R^{16}$ and $R^{17}$ can be the same or different and individually represent alkyl, preferably containing 1 to 25 carbon atoms, such as methyl, ethyl, propyl, butyl, decyl and eicosyl; aryl, preferably aryl containing 6 to 25 carbon atoms, such as phenyl and naphthyl; or amino, for example

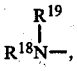

wherein $R^{18}$ is alkyl, such as alkyl containing 1 to 25 carbon atoms, for example methyl, ethyl, propyl, butyl, decyl and eicosyl; or aryl, such as aryl containing 6 to 25 carbon atoms, for example phenyl and naphthyl; and, $R^{19}$ is hydrogen or alkyl containing 1 to 25 carbon atoms, such as methyl, ethyl, propyl, butyl, decyl and eicosyl; and, $Z^2$ and $Z^3$ are as defined above.

A further class of useful couplers is the class of pyrazolone couplers containing a carbamoyloxy group in the coupling position. Such couplers consist essentially of a pyrazolone coupler represented by the formula:

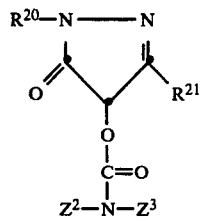

wherein $R^{20}$ and $R^{21}$ can be the same or different and individually represent hydrogen, aryl, such as aryl containing 6 to 25 carbon atoms, for example phenyl, naphthyl, benzyl, and tolyl; or, alkyl, such as alkyl containing 1 to 25 carbon atoms, for example methyl, ethyl, propyl, butyl, decyl and eicosyl; and additionally $R^{21}$ can represent a 5 or 6 member heterocyclic group, such as morpholino, benzothiazolyl or pyridyl; amino,

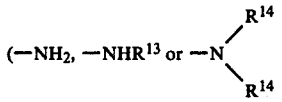

wherein $R^{13}$ and $R^{14}$ are as defined), such as alkylamino, for example, ethylamino and propylamino, and arylamino, for example, phenylamino; carboxamido

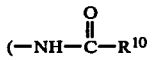

wherein $R^{10}$ is as defined), for example methylcarboxamido, ethylcarboxamido and phenylcarboxamido; and $Z^2$ and $Z^3$ are as defined.

The useful pyrazolone couplers generally require more vigorous processing conditions, including higher processing temperatures and longer processing times, than the other couplers in a photothermographic material and process.

Combinations of cyan, yellow and magenta dye-forming couplers are also useful.

A preferred photothermographic material comprises a coupler selected from the group consisting of (a) 1-hydroxy-2-(N-2-tetradecyloxyphenyl)-carbamoyl-4-carbamoyloxynaphthene, (b) 2-chloro-3-methyl-4-carbamoyloxy-6-(α-2,4-di-t-pentylphenoxybutyrylamido)-phenol, (c) 2-acetamido-4-carbamoyloxyphenol, and combinations thereof.

Carbamoyloxy substituted couplers according to the invention are prepared by procedures known in the organic synthesis art. An illustrative process of preparing a carbamoyloxy substituted coupler is the preparation of the coupler: 1-hydroxy-2-(N-2-tetradecyloxyphenyl)carbamoyl-4-carbamoyloxynaphthene. This preparation is illustrated by the reaction:

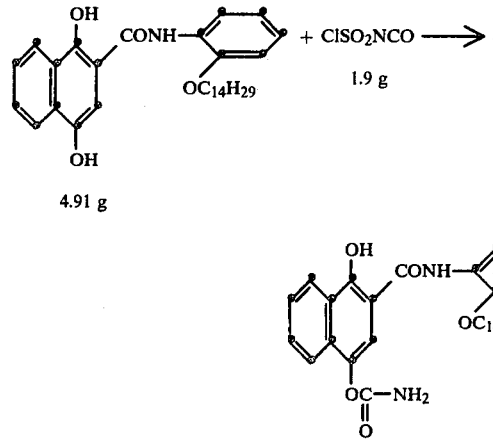

In this preparation, chlorosulfonylisocyanate (1.9 grams) is added to a stirred solution of the naphthyl compound (4.91 grams) in $CH_3CN$ (100 ml). Stirring is continued for 2 hours and then water is added (30 ml). Stirring is continued for 4–6 hours and the mixture is then filtered to remove the desired solid. The desired product is recrystallized from methanol to provide the desired carbamoyloxy substituted phenolic coupler having a melting point 145°–146° C. This reaction is described in, for example, an article by J. K. Rasmussen and A. Hassner, Chemical Reviews, Vol. 76, No. 3, pp. 389 and following (1976).

The hue of the dye produced from the reaction of the coupling moiety with the oxidized form of the developing agent varies, depending upon such factors as the particular groups on the coupler, the particular reducing agent, processing conditions, and other components in the photothermographic or thermographic material. In some cases the dye from the carbamoyloxy substituted coupler is not visible in the visible region of the electromagnetic spectrum. For example, some dyes produced from the carbamoyloxy substituted couplers absorb in the ultraviolet region of the electromagnetic spectrum. Most dyes produced from the carbamoyloxy substituted couplers are visible in the visible region of the electromagnetic spectrum. The nature of absorption and degree of absorption of the dyes depends upon the nature of the particular coupler and the substituent groups on the coupling moiety as well as the particular oxidized form of the reducing agent.

Generally, the carbamoyloxy substituted couplers are colorless in a photothermographic material or thermographic material prior to imagewise exposure and processing. Some of the carbamoyloxy substituted couplers have a slight color in the photothermographic material or thermographic material. This slight color is not considered unacceptable.

The term "colorless" herein means that the carbamoyloxy substituted coupler according to the invention does not absorb radiation to an undesired degree in the visible region of the electromagnetic spectrum. In some photothermographic materials and thermographic materials, the carbamoyloxy substituted couplers absorb radiation in certain areas of the electromagnetic spectrum which does not adversely affect the desired properties of the photothermographic material or thermographic material or the desired image formed upon processing.

The photothermographic materials according to the invention comprise photographic silver halide as a photographic component. It is essential that the photographic silver halide not adversely affect the desired imaging process, such as the oxidative coupling reaction or the thermal release of ammonia or amine. Examples of useful photographic silver halides are silver chloride, silver bromide, silver bromoiodide, silver chlorobromoiodide, silver iodide and mixtures thereof. The photographic silver halide is generally present in the photographic material in the form of an emulsion which is a dispersion of the photographic silver halide in a suitable binder. The photographic silver halide is present in a range of grain sizes from fine grain to coarse grain. Tabular grain photographic silver halides are useful. The composition containing the photographic silver halide is prepared by any of the well-known procedures in the photographic art, such as described in *Research Disclosure,* December 1978, Item No. 17643; *Research Disclosure,* June 1978, Item No. 17029 and *Research Disclosure,* January 1983, Item No. 22534, the disclosures of which are incorporated herein by reference. The photothermographic material contains addenda commonly present in photothermographic silver halide materials, such as chemical sensitizers, brighteners, antifoggants, emulsion stabilizers, light-absorbing or scattering materials, hardeners, coating aids, plasticizers, lubricants and antistatic materials, matting agents, development modifiers and other addenda described in *Research Disclosure,* June 1978, Item No. 17029. The photothermographic material can comprise photographic silver halide designed to produce positive images, such as internal image photographic silver halide and internally sensitized covered grain silver halide.

The photographic silver halide is generally spectrally sensitized by means of spectral sensitizing dyes, such as described in *Research Disclosure,* December 1978, Item No. 17643 and *Research Disclosure,* June 1978, Item No. 17029. Spectral sensitizing dyes which are useful in the photothermographic material of the invention include polymethine sensitizing dyes which include the cyanines, merocyanines, complex cyanines and merocyanines (including tri-, tetraand polynuclear cyanines and merocyanines), as well as oxonols, hemioxonols, styryls, merostyryls and streptocyanines. Combinations of spectral sensitizing dyes are useful.

The photothermographic material contains a range of concentrations of photographic silver halide. An optimum concentration of photographic silver halide will depend upon such factors as the desired image, processing conditions, particular dye formed from the carbamoyloxy substituted coupler according to the invention and other components in the photothermographic material. A useful concentration of photographic silver halide in the photographic material according to the invention is within the range of about 0.01 mole to about 1 mole of photographic silver halide per mole of developer in the photothermographic material. The coverage of photographic silver halide is generally less than otherwise might be useful, due to the enhancing properties of the dye produced upon processing of the photothermographic material.

The carbamoyloxy substituted coupler is in any location in the photothermographic material or thermographic material which produces the desired dye and the desired carbamic acid fragment upon processing. According to the invention, the carbamoyloxy substituted coupler is in a location with respect to the photographic silver halide and the oxidized form of the reducing agent that produces a silver image and releases a carbamic acid fragment upon appropriate processing. If desired, a portion of the carbamoyloxy substituted coupler is in a layer contiguous to the layer of the photothermographic element or thermographic element comprising the oxidized form of the reducing agent and/or the photographic silver halide. The term "in reactive association" herein means that the carbamoyloxy substituted coupler and the oxidized form of the reducing agent are in a location with respect to each other which enables the desired photothermographic material or thermographic material upon appropriate processing to produce a desired image.

Many dye-forming reducing agents are useful in a photothermographic material or thermographic material according to the invention. Carbamoyloxy substituted couplers are useful with dye-forming silver halide developing agents described in, for example, *Research Disclosure,* June 1978, Item No. 17029. Examples of such silver halide developing agents include, for example, phenylenediamines such as paraphenylenediamine, N,N-dialkyl-p-phenylenediamine, such as N,N-diethyl-p-phenylenediamine (also known as 4-amino-N,N-diethylaniline), N,N-dimethyl-p-phenylenediamine (also known as 4-amino-N,N-dimethylaniline), N,N-diethyl-3-methyl-p-phenylenediamine (also known as 4-amino-3-methyl-N,N-diethylaniline), 4-amino-N-ethyl-N-$\beta$-hydroxyethylaniline, 4-amino-3-methyl-N-ethyl-N-$\beta$-hydroxyethylaniline, 4-amino-3-methoxy-N-ethyl-N-$\beta$-hydroxyethylaniline, 4-amino-N-butyl-N-gamma-sulfobutylaniline; 4-amino-3-methyl-N-ethyl-N-$\beta$-sulfoethylaniline, 4-amino-3-$\beta$-(methanesulfonamido) ethyl-N,N-diethylaniline, 4-amino-3-methyl-N-ethyl-N-$\beta$-(methanesulfonamido) ethylaniline and 4-amino-3-methyl-N-ethyl-N-$\beta$-methoxyethylaniline; p-ureido-N,N-dialkylanilines, such as p-ureido-N,N-dimethylaniline and p-ureido-N,N-diethylaniline; aminophenols, such as 4-amino-2,6-dibromophenol, 4-amino-2-methylphenol sulfate, 4-amino-3-methylphenol sulfate, 4-amino-2,6-dichlorophenol hydrochloride; hydrazones, such as 3-methyl-2-benzothiazolinone hydrazone and ureidoanilines, such as ureidoanilines described in copending U.S. patent application Ser. No. 446,737 of A. Adin and R. C. DeSelms, filed Dec. 2, 1982 now U.S. Pat. No. 4,426,441, the description of which is incorporated herein by reference. Combinations of silver halide developing agents are also useful.

Examples of useful ureidoaniline reducing agents are represented by the formula:

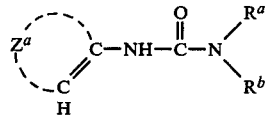

wherein $Z^a$ is the atoms, preferably selected from the group consisting of carbon, hydrogen, nitrogen and oxygen atoms necessary to complete an aniline silver halide developoing agent;

$R^a$ is alkyl, for example, alkyl containing 1 to 25 carbon atoms, such as methyl, ethyl, propyl, butyl, decyl, eicosyl and pentacosyl; benzyl and $$-R^c-\overset{O}{\overset{\|}{C}}-O-R^d;$$

aryl, for example, aryl containing 1 to 25 carbon atoms, such as phenyl, methoxyphenyl, 3-hydroxy-5-methylphenyl, naphthyl, tolyl and xylyl; or with $R^b$ is the atoms selected from the group consisting of carbon, nitrogen and oxygen atoms necessary to complete a 5 or 6 member nonaromatic heterocyclic group, such as a pyrrolino, pyrrolidino, piperazino or piperidino group;

$R^b$ is hydrogen; alkyl, for example, alkyl containing 1 to 25 carbon atoms, such as methyl, ethyl, propyl, butyl, decyl, eicosyl and pentacosyl; aryl, for example, aryl containing 6 to 25 carbon atoms, such as phenyl, naphthyl, tolyl and xylyl; or with $R^a$ is the atoms selected from carbon, nitrogen and oxygen atoms necessary to complete a 5 or 6 member nonaromatic heterocyclic ring;

$R^c$ is alkyl, for example, alkyl containing 1 to 25 carbon atoms, such as methyl, ethyl, propyl, butyl, octyl, decyl, eicosyl and pentacosyl; or aryl, for example, aryl containing 6 to 25 carbon atoms, such as phenyl, naphthyl, tolyl and xylyl; and $R^d$ is alkylene, for example, alkylene containing 1 to 25 carbon atoms, such as methylene, ethylene and hexadecylene; or arylene, for example, arylene containing 6 to 25 carbon atoms, such as phenylene, tolylene and xylene. The substituent groups or the ureidoaniline developing agent should not interfere with the desired oxidative coupling reaction. The ureidoaniline developing agent should be free of strong electron withdrawing groups. Examples of useful ureidoaniline developing agents are as follows:

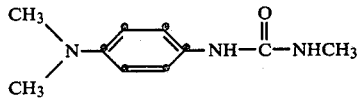

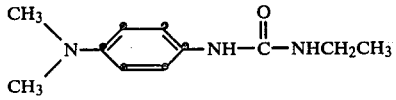

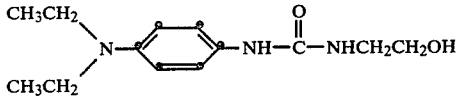

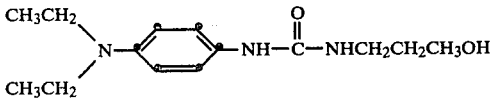

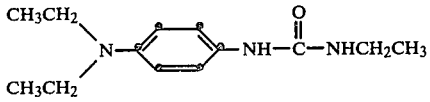

The silver halide developing agent or silver halide developing agent combination is useful in a range of concentrations in the photothermographic material and thermographic material according to the invention. An optimum concentration of silver halide developing agent or silver halide developing agent combination will depend upon such factors as the particular carbamoyloxy substituted coupler, the particular photothermographic material, the desired image, processing conditions, the particular developing agent or developing agent combination. A preferred concentration of developing agent or developing agent combination is within the range of about 0.1 to about 10 moles of developing agent or developing agent combination per mole of photographic silver halide in the photothermographic material.

The term "developing agent" herein includes compounds which are developing agents and developing agent precursors. That is, those compounds are included which are not developing agents in the photothermographic material until a condition occurs, such as heating or contact with a suitable activator for the photothermographic material.

The silver halide developing agent or developing agent combination is optionally incorporated in the photothermographic material. Generally, the developing agent or developing agent combination is most useful incorporated in the photothermographic material.

The tone of the image, such as the silver image and dye image, produced in a photothermographic material or thermographic material according to the invention varies depending upon such factors as the silver morphology of the developed silver image, the covering power of the silver materials, the particular dye formed, processing conditions, concentrations of components, and other materials present in the photothermographic material. In photothermographic materials that produce a brown silver image, a dye produced from the oxidative coupling reaction is especially useful which is complementary in hue to the silver image.

The photothermographic materials and thermographic materials according to the invention generally comprise a binder. Binders are useful alone or in combination in a photothermographic material or thermographic material according to the invention. Useful binders in the photothermographic material include both naturally-occurring substance such as proteins, for example, gelatin, gelatin derivatives, cellulose derivatives, polysaccharides such as dextran, gum arabic and the like; and synthetic polymeric materials which are compatible with the carbamoyloxy substituted couplers, such as water soluble polyvinyl compounds, such as polyvinyl pyrrolidone and acrylamide polymers. Hydrophobic binders are also useful. Useful hydrophobic binders include polymers of alkylacrylates and methacrylates, acrylic acid, poly(vinyl butyral), cellulose acetate butyrate, poly(methylmethacrylate), poly(styrene), poly(vinyl chloride), chlorinated rubber, poly(isobutylene), butadiene-styrene copolymers, vinylchloride-vinylacetate copolymers, copolymers of vinylacetate, vinylchloride and maleic anhydride and the like. Poly(vinyl butyral) is especially useful. This is available under the trademark "BUTVAR" from the Monsanto Company, U.S.A.

A range of concentration of binder is useful in a photothermographic material or thermographic material according to the invention. An optimum concentration of binder will depend upon the described factors such as particular binder, other components in the photothermographic material, coating conditions, desired image, processing temperature and conditions, and the particular carbamoyloxy substituted coupler. A preferred concentration of binder is within the range of about 10 to about 100 mg of binder per square decimeter of support.

If desired, a portion or all of the photographic silver halide in a photothermographic material according to the invention is prepared in situ in the photothermographic material. In this preparation the photographic silver halide is prepared in or on one or more of the other components of the photothermographic material rather than prepared separate from the described components and then admixed with them. Such a method of preparing silver halide in situ is described in, for example, U.S. Pat. No. 3,457,075.

The photothermographic material can also comprise photographic silver halide prepared ex situ, such as described in U.S. Pat. No. 4,264,725.

If desired, the photothermographic elements according to the invention contain an overcoat layer and/or interlayer and/or subbing layer to provide desired properties. The overcoat layer, for example, increases resistance to abrasion and other markings on the element and can improve storage stability and thermal processing.

A photothermographic element or thermographic element according to the invention comprises a variety of supports. Useful supports include those which are resistant to adverse changes in structure due to processing conditions and which do not adversely affect the desired sensitometric properties of the photothermographic and thermographic materials. Useful supports include, for example, cellulose ester, poly(vinyl acetal), poly(ethylene terephthalate) and polycarbonate films, as well as related films and resinous materials. Glass, paper, metal and the like supports are also useful. A flexible support is generally most useful.

The photothermographic and thermographic materials according to the invention are coated on a suitable support by procedures known in the photographic art. Such procedures include, for example immersion or dip coating, roller coating, reverse roll coating, airknife coating, doctor blade coating, spray coating, extrusion coating, dip coating, stretch flow coating and curtain coating.

In preparing a photothermographic material or thermographic material comprising the carbamoyloxy substituted couplers according to the invention, a dispersion solvent is optionally useful to produce a coating composition. A coupler solvent known in the photographic art is optionally useful for aiding dispersion of the coupler. Examples of optional coupler solvents include N-n-butylacetanilide, diethyl lauramide, di-n-butylphthalate and 2,4-ditertiary amylphenol. The carbamoyloxy substituted coupler is optionally loaded into a latex, or a non-solvent dispersion is prepared if desired.

The photothermographic materials according to the invention are generally imagewise exposed by means of various forms of energy to produce a developable image. Such forms of energy include those to which the photographic material, especially the photographic silver halide, is sensitive. These forms of energy include the ultraviolet, visible and infrared regions of the electromagnetic spectrum, as well as electron beam and beta radiation, gamma ray, x-ray, alpha particle, neutron radiation and other forms of corpuscular wavelength radiation in either non-coherent (random phase) forms or coherent (in phase) forms as produced by lasers. Exposures are monochromatic, orthochromatic or panchromatic, depending upon the spectral sensitization of the photographic silver halide. Imagewise exposure is generally for a sufficient time and intensity to produce a developable latent image in the photothermographic material.

The photothermographic material and thermographic material according to the invention preferably comprise at least one image-forming material which generates an image in response to the presence of ammonia or an amine from the carbamic acid fragment released from the coupler. An illustrative preferred example of such an amine responsive material is one that comprises an aromatic dialdehyde capable of reacting with ammonia or an amine generated from the carbamic acid fragment. Such an aromatic aldehyde is, for example, ortho-phthalaldehyde capable of reacting with ammonia or an amine generated from the carbamic acid fragment. The photothermographic material and thermographic material also preferably comprise a reducible cobalt(III) complex containing releasable amine ligands.

A preferred embodiment of the invention comprises a photothermographic element comprising a support bearing, in reactive association, in a binder, photographic silver halide, a silver halide developing agent and a coupler that is capable of oxidative coupling with the oxidized form of the developing agent, wherein the coupler is a carbamoyloxy substituted coupler that, upon oxidative coupling with the oxidized form of the developing agent, releases a carbamic acid fragment that, in turn, is capable of thermally releasing ammonia or an amine; and, also comprising, in at least one operatively associated layer, an ammonia or amine activatable image precursor composition comprising at least one cobalt(III) complex having releasable ligands and an image-forming material which generates an image in response to the release of the ligands. A preferred image precursor composition comprising at least one cobalt(III) complex comprises a cobalt(III) hexammine complex and ortho-phthalaldehyde. Such cobalt(III) complex image-forming materials are known in the imaging art and are described in, for example, *Research Disclosure,* Item No. 16845; *Research Disclosure,* Item No. 12617; *Research Disclosure,* Item No. 18535; *Research Disclosure,* Item No. 15874; *Research Disclosure,* Item No. 18436; U.S. Pat. No. 4,273,860; U.K. Published Application No. 2,012,445A; European Patent 12855; and published Application WO 80/01322, the disclosures of which are incorporated herein by reference.

Preferred cobalt(III) complexes useful in a photothermographic element or thermographic element according to the invention feature a molecule having a cobalt atom or ion surrounded by a group of atoms, ions or other molecules which are generically referred to as ligands. The cobalt atom or ion in the center of these complexes is a Lewis acid while the ligands are Lewis bases. Trivalent cobalt complexes, that is cobalt(III) complexes, are generally most useful according to the invention because the ligands are relatively tenaciously held in these complexes and released when the cobalt is reduced to the (II) state.

Preferred cobalt(III) complexes are those having a coordination number of six. A wide variety of ligands are useful to form a cobalt(III) complex. The preferred cobalt(III) complex is one which releases an amine or ammonia to generate a dye or destroy a dye. Cobalt(III) complexes which rely upon chelation of cobalt(II) to form added dye density are also useful in photothermographic and thermographic materials according to the invention. Useful amine ligands in cobalt(III) complexes according to the invention include, for example, methylamine, ethylamine, ammines, and amino acids such as glycine. The term "ammine" refers to ammonia, when functioning as a ligand, whereas "amine" indicates the broader class noted above. The ammine complexes are highly useful in producing dye images.

The cobalt(III) complexes useful according to the invention include neutral compounds which are entirely free of either anions or cations. The cobalt(III) complexes can also include one or more cations and anions as determined by the charge neutralization rule. Herein the terms "anion" and "cation" refer to non-ligand anions and non-ligand cations unless otherwise indicated. Useful cations are those which produce readily soluble cobalt(III) complexes, such as alkali metals and quaternary ammonium cations.

A wide variety of anions are useful, such as those listed in *Research Disclosure,* Item No. 18436. The choice of an optimum anion depends in part on whether or not added compounds are present that are sensitive to, or reactive with, the anion.

The image-forming material containing a cobalt(III) complex optionally comprises compounds or compositions in addition to the cobalt(III) complex. Such materials are, for example, dye-forming materials or dyes which are bleachable in response to ammonia or amines. Examples of dye-forming materials which also comprise destabilizer materials to interact with the cobalt(III) complex are known in the photographic art, such as described in U.S. Pat. No. 4,273,860, the disclosure of which is incorporated herein by reference. Such dye-forming materials include, for example, 4-methoxynaphthol which forms a blue dye when oxidized and protonated diamine destabilizer material which when associated with a conventional color coupler will form a dye when it is oxidized by the reduction of the cobalt(III) complex. Examples of image-forming materials useful in addition to a destabilizer material include ortho-phthalaldehyde, also present as an amplifier; an ammonia-bleachable or color alterable dye such as a cyanine dye, styryl dye, rhodamine dye, azo dye or pyrylium dye; a dye precursor such as a ninhydrin; or a diazo/coupler material which is capable of forming a diazo dye. Details of these examples are described in, for example, *Research Disclosure,* October 1974, Item No. 12617, the disclosure of which is incorporated herein by reference. Another optional addenda is a compound which will chelate with the cobalt(II) to form a dye.

When ammonia-bleachable image-forming materials are present in the photothermographic element or thermographic element according to the invention, the ammonia-bleachable materials are preferably in a layer separate from the ammonia or amine producing components of the materials.

The layer comprising cobalt(III) complexes preferably comprises a binder. Useful binders are described in, for example, *Research Disclosure,* October 1974, Item No. 12617 and U.S. Pat. No. 4,247,625, the descriptions of which are incorporated herein by reference. Useful binders are, for example, cellulose compounds, vinyl polymers, polyacrylates and polyesters. In addition, it is preferred that the binder be selected which will maximize the preferred hue and density of dye produced upon exposure and development. Preferred examples of useful binders include polysulfonamides, for example, poly(ethylene-co-1,4-cyclohexylene-dimethylene-1-methyl-2,4-benzene disulfoamide), poly(ethylene-co-hexamethylene-1-methyl-2,4-benzene disulfonamide) and poly(methacrylonitrile).

A preferred ammonia or ammine responsive photothermographic element or thermographic element according to the invention comprises a support bearing a layer comprising, in a polysulfonamide binder, orthophthalaldehyde and a cobalt(III) hexammine trifluoroacetate which is overcoated with a suitable polymeric overcoat, such as a poly(acrylamide-co-N-vinyl-2-pyrrolidone-co-2-acetoacetoxyethylmethacrylate). An imaging element containing these components when placed contiguous to a photothermographic element containing photographic silver halide, a developing agent, and a carbamoyloxy substituted coupler according to the invention produces a dye image upon heating the combined layers during processing.

A preferred photothermographic material according to the invention is a photothermographic material designed for dry physical development. Such photothermographic materials designed for dry physical development are described in, for example, *Research Disclosure,* June 1978, Item No. 17029, the description of which is incorporated herein by reference. Such a photothermographic element comprises, for example, a support bearing, in reactive association, in binder, (a) photographic silver halide, (b) an image-forming combination comprising (i) an organic heavy metal salt oxidizing agent, such as an organic silver salt oxidizing agent, with (ii) an organic reducing agent for the organic heavy metal salt oxidizing agent, and (c) a coupler that is capable of oxidative coupling with the oxidized form of the reducing agent, wherein the coupler is a carbamoyloxy substituted dye-forming coupler that, upon oxidative coupling with the oxidized form of the reducing agent, releases a carbamic acid fragment that, in turn, is capable of thermally releasing ammonia or an amine.

The photothermographic material is generally imagewise exposed to light to provide a developable latent image which is then developed by merely uniformly heating the photothermographic material to processing temperature, such as a temperature within the range of about 100° C. to about 200° C. This enables formation of a silver image, a dye from the oxidative coupling reaction, and thermal decomposition of the carbamic acid fragment to form ammonia or an amine which aids in processing and formation of a dye. The ammonia or amine released from the carbamic acid fragment is generally transferred to a contiguous layer containing an ammonia or amine responsive imaging material.

A variety of organic heavy metal salt oxidizing agents, preferably organic silver salt oxidizing agents, are useful in a photothermographic and thermographic material according to the invention. Examples of useful organic silver salt-oxidizing agents are described in, for example, *Research Disclosure,* June 1978, Item No. 17029, the description of which is incorporated herein by reference. Examples of useful organic silver salt oxidizing agents include silver salts of long-chain fatty acids, that is silver salts of acids containing 17 to 30 carbon atoms, such as silver behenate, silver palmitate, silver stearate and silver laurate. Other silver salts of organic oxidizing agents include, for example, silver salts of 1,2,4-mercaptotriazole derivatives, such as described in *Research Disclosure,* June 1977, Item No. 15869, the description of which is incorporated herein by reference. Another useful class of organic silver salt oxidizing agents is represented by the complexes or salts of silver with a nitrogen acid, such as nitrogen acid selected from the group consisting of imidazole, pyrazole, urazole, 1,2,4-triazole and 1H-tetrazole nitrogen acids or combinations of these acids. These silver salts of nitrogen acids are described in, for example, *Research Disclosure,* October 1976, Item No. 15026, the disclosure of which is incorporated herein by reference. Examples of useful silver salts or complexes of nitrogen acids include silver salts or complexes of 1H-tetrazole; dodecyltetrazole; 5-n-butyl-1H-tetrazole; 1,2,4-triazole; urazole; pyrazole; imidazole; and benzimidazole. A further class of useful organic silver salt oxidizing agents includes silver salts of certain heterocyclic compounds such as described in U.S. Pat. No. 3,893,860, the description of which is incorporated herein by reference. Selection of an optimum organic silver salt or complex oxidizing agent, or combination of such oxidizing agents, will depend upon such factors as the desired image, particular silver halide, particular reducing agent, particular carbamoyloxy substituted coupler, processing conditions and ammonia or amine responsive imaging material in the photothermographic and thermographic material.

The terms "salt" and "complex" herein include any type of bonding or complexing mechanism which enables the resulting material to provide desired imaging properties in the photothermographic and thermographic materials according to the invention. In some instances the exact bonding of the described organic silver salt or complex is not fully understood. The terms "salt" and "complex" are intended to include neutral complexes and non-neutral complexes. A preferred photothermographic element according to the invention comprises a support bearing, in reactive association, in binder, such as a poly(vinyl butyral) binder, (a) photographic silver halide, prepared in situ or ex situ; (b) an image-forming combination comprising (i) a silver behenate oxidizing agent, with (ii) a phenylenediamine or ureidoaniline reducing agent for silver behenate; (c) a toner; and (d) a coupler that is capable of oxidative coupling with the oxidized form of the reducing agent to form a dye, wherein the coupler consists essentially of 2-chloro-3-methyl-4-carbamoyloxy-6-(α-2,4-di-t-pentylphenoxybutyrylamido)phenol. The photothermographic element also preferably comprises at least one image-forming material which generates an image in response to the presence of ammonia or an amine from the carbamic acid fragment.

The photothermographic material according to the invention generally comprises an image toner to produce a desired tone for an image produced. For example, a toner is present in the photothermographic material to produce a more nearly neutral appearing or black tone image upon processing if desired. Combinations of image toners are also useful. The optimum toning agent or toning agent combination will depend upon such factors as the particular silver halide, the desired image, particular processing conditions, particular components in the photothermographic material or thermographic material and the particular carbamoyloxy substituted coupler. In a photothermographic material comprising an organic silver salt oxidizing agent which is a silver salt of a nitrogen acid, useful toning agents include, for example, 5-amino-1,3,4-thiadiazole-2-thiol; 3-mercapto-1,2,4-triazole and bis(dimethylcarbamyl) disulfide. Other toning agents are described in, for example, *Research Disclsoure,* June 1978, Item No. 17029, the description of which is incorporated herein by reference.

The toning agent or toning agent combination is useful in a range of concentrations in a photothermographic material or thermographic material according to the invention. The optimum concentration of toning agent or toning agent combination will depend upon the described factors such as the particular photographic silver halide, desired image, processing conditions, other components in the photothermographic material, and the particular carbamoyloxy substituted coupler. A preferred concentration of toning agent or toning agent combination is within the range of about 0.01 to about 0.1 mole of toning agent per mole of organic silver salt oxidizing agent in the photothermographic material or thermographic material.

A preferred toner or toner combination is selected from the group consisting of phthalazinone, phthalazine, N-hydroxynaphthalimide and succinimide toners.

The photothermographic material or thermographic material can comprise a melt-forming compound to aid in processing. The melt-forming compound generally provides an improved developed image. The term "melt-forming compound" herein means a compound which upon heating to the described processing temperature produces an improved reaction medium, generally a melt medium, within which the image-forming combination and photosensitive component produce better image development. The exact nature of the reaction medium in the photothermographic material and thermographic material at processing temperature is not fully understood; however, it is believed at the reaction temperatures a melt occurs which permits the reaction components to better interact and diffuse into contiguous layers of the photothermographic element and thermographic element. Useful melt-forming compounds are generally components separate from the image-forming combination, although the image-forming combination and other addenda in the photothermographic material or thermographic material enter into the melt formation. Useful melt-forming compounds are amides, imides, cyclic ureas and triazoles which are compatible with other components of the photothermographic materials and thermographic materials. Useful melt-forming compounds are generally selected from those described in, for example, U.S. Pat. No. 3,438,776. Examples of useful melt-forming compounds include acetamide, 1,3-dimethylurea, N-propylurea, 2-pyrrolidone and formamide.

The melt-forming compound is useful in a range of concentrations in the photothermographic materials and thermographic materials according to the invention. Preferred concentrations of melt-forming compounds or combinations of melt-forming compounds are within the range of about 0.5 to about 2 parts by weight of the melt-forming compound per gram of organic silver salt oxidizing agent in the photothermographic material or thermographic material. The optimum concentration of melt-forming compound or combination of melt-forming compounds will depend upon the described factors.

An image is produced in an exposed photothermographic element according to the invention by heating the element to a temperature within the range of about 100° C. to about 200° C. until an image is developed, typically within about 2 to about 60 seconds. Selection of an optimum time and temperature for processing will depend upon such factors as the desired image, particular components of the photothermographic material, the particular amine or ammonia responsive imaging component, the particular carbamoyloxy substituted coupler and other components in the photothermographic material.

A variety of means are useful to produce the necessary heating of the exposed photothermographic material to develop the desired image. The heating means is, for example, a suitable hot plate, heated drum, iron, roller, infrared heating means, hot air heating means or the like.

Processing according to the invention is generally carried out under ambient conditions of pressure and humidity. Pressures and humidity outside normal atmospheric conditions are useful if desired; however, atmospheric conditions are preferred.

A stabilizer or stabilizer precursor is generally desirable in a photothermographic material according to the invention to provide improved post-processing image stability. It is desirable in most instances to stabilize the silver halide after processing in order to avoid post-processing printup. A variety of stabilizers and stabilizer precursors are useful in the photothermographic materials according to the invention. The stabilizers and stabilizer precursors are useful alone or in combination. Generally useful stabilizers and stabilizer precursors are photolytically active halogenated organic compounds and/or sulfur compounds that form a stable silver mercaptide after image development with the photographic silver halide at processing temperatures. Such stabilizers and stabilizer precursors are described in, for example, *Research Disclosure,* June 1978, Item No. 17029, the description of which is incorporated herein by reference. Selection of an optimum stabilizer or stabilizer precursor or combination thereof will depend upon such factors as the particular photographic silver halide, processing conditions, desired image, and other components in the photothermographic material.

An optional embodiment of the invention is a photothermographic assemblage comprising a support bearing, in reactive association, (a) a photothermographic silver halide layer comprising photographic silver halide and a silver halide developing agent in a binder, and (b) an image-receiving layer which is capable of forming an image in response to a component transferred from (a) to (b) upon thermal processing of the photothermographic assemblage, wherein the photothermographic silver halide layer (a) comprises a carbamoyloxy substituted coupler that upon oxidative coupling with the oxidized form of the silver halide developing agent, releases a carbamic acid fragment that, in turn, is capable of thermally releasing ammonia or an amine that is capable of being transferred from (a) to (b). Upon thermal processing a silver and dye image is formed in (a) of the photothermographic assemblage. Also, a dye is formed in (b) in response to the ammonia or amine transferred into the image-receiving layer.

A preferred photothermographic assemblage according to the invention comprises a support bearing, in reactive association, (a) a photothermographic silver halide layer comprising (i) photographic silver halide, (ii) an image-forming combination comprising a silver behenate oxidizing agent with a phenylenediamine or ureidoaniline reducing agent for silver behenate, and (iii) a carbamoyloxy substituted dye-forming coupler consisting essentially of 2-chloro-3-methyl-4-carbamoyloxy-6-(α-2,4-di-t-pentylphenoxybutyrylamido)-phenol; in a binder; and (b) an image-receiving layer which comprises, in a polysulfonamide binder, cobalt(III) amine complex, such as cobalt(III) hexammine trifluoroacetate and ortho-phthalaldehyde.

A thermographic material according to the invention comprises the same components as a photothermographic material without the need for photographic silver halide. A thermographic process for producing an image in a thermographic element according to the invention comprises imagewise heating the thermographic element to a temperature within the range of about 100° C. to about 200° C. until the image is produced.

The carbamoyloxy substituted coupler is, in one embodiment of the invention, incorporated in a photographic silver halide processing composition for producing a silver image and dye image. Such a processing composition optionally comprises a silver halide developing agent and the carbamoyloxy substituted coupler. The photographic processing composition is, for example, a silver halide developing composition, hardening composition or stabilizing composition. The processing composition generally comprises an auxiliary base or base-release agent. A preferred photographic processing composition comprises a phenylenediamine or ureidoaniline silver halide developing agent and a carbamoyloxy substituted coupler as described above. The processing composition is activated by heating the processing composition to enable the release of the carbamic acid fragment that in turn thermally releases ammonia or an amine.

The following examples are included for a further understanding of the invention.

EXAMPLE 1

This illustrates use of 1-hydroxy-2-(N-2-tetradecyloxyphenyl)-carbamoyl-4-carbamoyloxynaphthene.

A photothermographic composition was prepared by mixing the following components:

| | Grams: |
|---|---|
| 1-hydroxy-2-(N—2-tetradecyloxyphenyl)-carbamoyl-4-carbamoyloxynaphthene (Coupler) represented by the formula: | 0.033 |

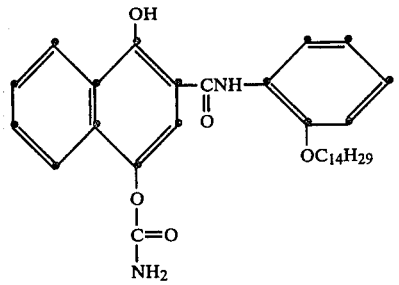

| | |
|---|---|
| N—(t-butyl)-N'—(4-diethylaminophenyl) urea (reducing agent) | 0.015 |
| 2-methoxyethanol (solvent) | 0.1 |
| tetrahydrofuran (solvent) | 0.2 |
| phthalazinone (2 mg in 0.2 g of tetrahydrofuran) (toner) | 0.2 |
| mercuric chloride (in one drop of tetrahydrofuran) (antifoggant) | 0.00125 |
| surfactant (6 mg of Pluronic L-121 in 0.20 mg of toluene) (Pluronic L-121 is an ethylene oxide-propylene oxide block copolymer and is a trademark of and available from BASF-Wyandotte, Inc., U.S.A.) | 0.2 |
| poly(vinyl butyral) (binder) (BUTVAR B-76 which is a trademark of and available | 0.2 |

-continued

| | Grams: |
|---|---|
| from the Monsanto Co., U.S.A.) (washed with methanol) (10 weight percent in toluene) | |
| silver behenate dispersion containing: | 0.6 |
| acetone | 406.9 |
| toluene | 438.3 |
| poly(vinyl butyral) (BUTVAR B-76) | 55.0 |
| alumina | 8.8 |
| behenic acid | 31.2 |
| lithium stearate | 5.9 |
| silver behenate (silver salt oxidizing agent) | 50.0 |
| silver bromoiodide emulsion containing: | 0.2 |
| acetone | |
| poly(vinyl butyral) (BUTVAR B-76) | |
| lithium iodide, anhydrous | |
| lithium bromide, anhydrous | |
| silver trifluoroacetate | |
| 15.7% solids | |
| 40 gm Ag/l of solution | |

The resulting photothermographic composition was coated at a wet coating thickness of 50.8 microns (2 mils) on a subbed poly(ethyleneterephthalate) film support to produce a photothermographic element. The coating was permitted to dry to produce a total silver coverage of 3.8 mg/dm$^2$ (35 mg/ft$^2$). Part of the photothermographic element was imagewise exposed through a 0.3 log E step tablet to light for $10^{-3}$ seconds in a commercial sensitometer. The exposed photothermographic element was then placed in face-to-face contact with a receiver element containing an ammonia responsive image forming material. The receiver element contained the following layers coated on a subbed poly(ethyleneterephthalate) film support:

| | mg/dm$^2$ |
|---|---|
| Ammonia Responsive Layer: | |
| surfactant (SF-1066 which is a copolymer of a dimethylpolysiloxane and a polyoxyalkylene ether and is a tradename of General Electric Co., U.S.A.) | 3.7 |
| poly(ethylene-co-1,4-cyclohexylene-dimethylene-1-methyl-2,4-benzenedisulfonamide) (50:50 weight ratio) (binder) | 75.6 |
| phthalaldehyde | 25.1 |
| cobalt (III) hexammine trifluoroacetate | 12.5 |
| Overcoat Layer: | |
| cobalt (III) hexammine trifluoroacetate | 3.2 |
| poly(acrylamide-co-N—vinyl-2-pyrrolidone-co-2-aceto-acetoxyethyl methacrylate) (binder) (50:45:5 weight ratio) | 21.6 |

The two elements were laminated by passing the resulting sandwich through a set of rollers at about 70 kPa (about 10 psi) and heated to about 121° C. The laminate sandwich was then heated for 7 seconds at 120° C. by means of a heated drum. The laminate sandwich was then peeled apart revealing a cyan image in the silver bromoiodide layer of the photothermographic element. The image in the silver bromoiodide layer of the photothermographic element when observed by means of red light had a diffuse Dmax of 1.2 and Dmin of 0.55. The layer of the element containing the ammonia responsive layer contained a high contrast neutral (black) image having a neutral diffuse Dmax of 2.95 and Dmin of 0.04.

EXAMPLE 2

This illustrates use of 2-chloro-3-methyl-4-carbamoyloxy-6-(alpha-2,4-di-t-pentylphenoxybutyrylamido)phenol.

A photothermographic element was prepared as described in Example 1 with the exception that the coupler was replaced by 0.021 g of the coupler: 2-chloro-3-methyl-4-carbamoyloxy-6-(alpha-2,4-di-t-pentylphenoxybutyrylamido)phenol represented by the structure:

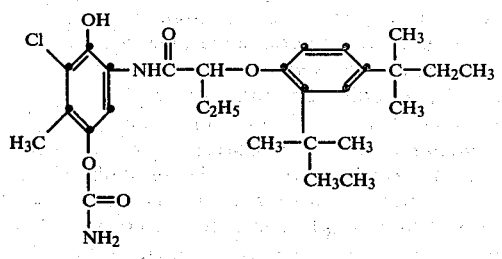

and the layer containing silver bromoiodide was coated at a wet coating thickness of 101.6 microns (4 mils). Also, the photothermographic film was imagewise exposed to light through a 0.3 log E step tablet for $10^{-2}$ seconds in a commercial sensitometer. The resulting exposed photothermographic element was laminated to an ammonia responsive element as described in Example 1. The resulting laminated sandwich was heated for five seconds at 110° C. by means of a heated drum. Then the sandwich was peeled apart revealing an image in the silver bromoiodide layer of the photothermographic element. The image in the silver bromoiodide layer when observed by red light had a Dmax of 1.8 and Dmin of 0.12. The element containing the ammonia responsive layer contained a neutral (black) image having a Dmax of 3.6 and Dmin of 0.05.

EXAMPLE 3

The procedure described in Example 2 was repeated with the exception that the cobalt (III) hexammine trifluoroacetate was omitted from the overcoat of the element containing the ammonia responsive layer. Also the support for the element containing the ammonia responsive layer was tinted gray. The laminated sandwich was heated for ten seconds at 110° C. by means of a heated drum. The laminated sandwich was then peeled apart to reveal an image in the silver bromoiodide layer of the photothermogaphic element having diffuse Dmax Of 1.98 and Dmin of 0.12 when observed by red light. The element containing the ammonia responsive layer contained an image having a neutral (black) diffuse Dmax of 3.6 and Dmin of 0.09.

EXAMPLE 4

This illustrates use of 2-acetamido-4-carbamoyloxy phenol.

A photothermographic element was prepared as described in Example 1 with the exception that the coupler was replaced by 0.008 g of the coupler: 2-acetamido-4-carbamoyloxyphenol represented by the structure:

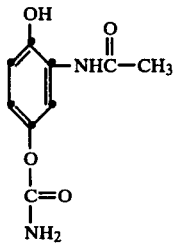

and the layer containing silver bromoiodide was coated at a wet coating thickness of 101.6 microns (4 mils). Also, the photothermographic film was imagewise exposed to light through a 0.3 log E step tablet for $10^{-2}$ seconds in a commercial sensitometer. The resulting exposed photothermographic element was laminated to an ammonia responsive element as described in Example 1. The resulting laminated sandwich was heated for seven seconds at 110° C. by means of a heated drum. Then the sandwich was peeled apart revealing an image in the silver bromoiodide layer of the photothermographic element. The image in the silver bromoiodide layer when observed by red light had a diffuse Dmax of 1.26 and Dmin of 0.11. The element containing the ammonia responsive layer contained a neutral (black) image having a diffuse Dmax of 3.4 and Dmin of 0.04.

EXAMPLE 5

The procedure described in Example 4 was repeated with the exception that the ammonia responsive element was the ammonia responsive element of Example 3 (cobalt (III) hexammine trifluoroacetate omitted from overcoat). The image in the silver bromoiodide layer when observed by red light had a diffuse Dmax of 1.26 and Dmin of 0.11. The element containing the ammonia responsive layer contained a neutral (black) image having a diffuse Dmax of 3.6 and a Dmin of 0.12.

EXAMPLE 6

A photothermographic element was prepared by mixing and coating at a 101.6 micron (4 mils) wet coating thickness on a subbed poly(ethyleneterephthalate) film support the following photothermographic composition:

| | Grams: |
|---|---|
| 2-chloro-3-methyl-4-carbamoyloxy-6-(alpha-2,4-di-t-pentylphenoxy-butyrylamido)phenyl (coupler) | 0.021 |
| pentanol (solvent) | 0.2 |
| phthalazinone (2 mg in 0.1 g of tetrahydrofuran) (toner) | 0.1 |
| 5-nitrobenzimidazole (antifoggant) | 0.005 |
| mercuric chloride (in one drop of tetrahydrofuran) | 0.00125 |
| toluene (solvent) | 0.16 |
| surfactant (6 mg of Pluronic L-121 in 0.2 g of toluene) | 0.2 |
| poly(vinylbutyral) (binder) (BUTVAR-76, 7 weight percent in toluene) (washed with methanol) | 0.14 |
| silver behenate dispersion (from Example 1) | 0.6 |
| silver bromoiodide emulsion (3.5 kg of Ag/mole) (0.24 μm AgBrI, containing 4 weight % n-pentanol and 0.4 weight % dioctylsulfosuccinate in 4 weight % poly(vinylbutyral) (BUTVAR B-76) in toluene) | 0.6 |

The photothermographic element was permitted to dry and then heated for two seconds at 110° C. to remove residual solvents. Part of the photothermographic element was imagewise exposed to light through a 0.3 log E step tablet and the following filters: Wratten 1A, 36 and 38A, for $10^{-3}$ seconds in a commercial sensitometer. (Wratten is a trademark of Eastman Kodak Company, U.S.A.) The filtered exposure consisted of blue light (exposure of 7 ergs/cm$^2$). The photothermographic element was then laminated in fact-to-face contact with an ammonia responsive element as described in Example 3 (cobalt (III) hexammine trifluoroacetate omitted from the overcoat) at 149° C. by means of rollers at 138 kPa (20 psi). The resulting sandwich was then heated at 120° C. for eight seconds by means of a heated drum. The sandwich was then peeled apart to reveal an image having a diffuse Dmax of 0.87 (observed by red light) and Dmin of 0.41. An image in the ammonia responsive element had a neutral Dmax of 2.60 and Dmin of 0.18.

The invention has been described in detail with particular reference to preferred embodiments thereof, but it will be understood that variations and modifications can be effected within the spirit and scope of the invention.

What is claimed is:

1. In a photothermographic element comprising a support bearing, in reactive association, in binder, photographic silver halide, a silver halide developing agent and a coupler that is capable of oxidative coupling with the oxidized form of said developing agent, the improvement wherein:

said coupler (a) comprises, in the coupling position, a carbamoyloxy group, and (b) upon oxidative coupling with the oxidized form of said developing agent, releases a carbamic acid fragment that, in turn, is capable of thermally releasing ammonia or an amine; and said photothermographic element comprises at least one image-forming material which generates a dye image in response to the presence of ammonia or an amine from the carbamic acid fragment.

2. A photothermographic element as in claim 1 wherein said coupler is a dye-forming coupler.

3. A photothermographic element as in claim 1 wherein said coupler consists essentially of a compound represented by the formula:

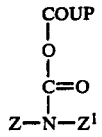

wherein

COUP (i) represents a coupling moiety that is capable of oxidative coupling with the oxidized form of said developing agent and (ii) contains the carbamoyloxy group in a coupling position; and Z and $Z^1$ are individually hydrogen, alkyl, aryl, or together are the atoms selected from the group consisting of carbon, hydrogen, nitrogen and oxygen atoms necessary to complete a 5 or 6 member heterocyclic group.

4. A photothermographic element as in claim 1 wherein said coupler consists essentially of a compound represented by the formula:

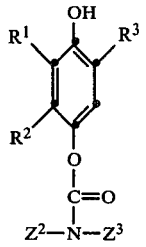

wherein $R^1$, $R^2$ and $R^3$ individually represent hydrogen, alkyl, halo, aryloxy, alkoxy, alkylcarbamoyl, arylcarbamoyl, heterylcarbamoyl, carboxamido, ureido,

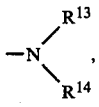

or $R^1$ together with $R^2$ represents the atoms necessary to complete a carbocyclic group; $R^{13}$ and $R^{14}$ are individually alkyl; and, $Z^2$ and $Z^3$ are individually hydrogen, alkyl containing 1 to 6 carbon atoms, aryl containing 6 to 10 carbon toms, or together are the atoms selected from the group consisting of carbon, hydrogen, nitrogen and oxygen atoms necessary to complete a 5 or 6 member heterocyclic group.

5. A photothermographic element as in claim 1 wherein said coupler consists essentially of an active methylene coupler represented by the formula:

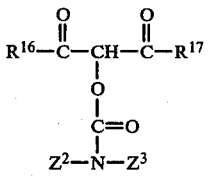

wherein $R^{16}$ and $R^{17}$ are individually alkyl, aryl or amino; and $Z^2$ and $Z^3$ are individually hydrogen, alkyl containing 1 to 6 carbon atoms, aryl containing 6 to 10 carbon atoms, or together are the atoms selected from the group consisting of carbon, hydrogen, nitrogen and oxygen atoms necessary to complete a 5 or 6 member heterocyclic group.

6. A photothermographic element as in claim 1 wherein said coupler consists essentially of a compound selected from the group consisting of (a) 1-hydroxy-2-(N-2-tetradecyloxyphenyl)-carbamoyl-4-carbamoyloxynaphthene, (b) 2-chloro-3-methyl-4-carbamoyloxy-6-(α-2,4-di-t-pentylphenoxybutyrylamido)phenol, (c) 2-acetamido-4-carbamoyloxyphenol, and combinations thereof.

7. In a photothermographic element comprising a support bearing, in reactive association, in binder (a) photographic silver halide, (b) an image-forming combination comprising (i) an organic heavy metal salt oxidizing agent with (ii) an organic reducing agent for the organic heavy metal salt oxidizing agent, (c) a coupler that is capable of oxidative coupling with the oxidized form of said reducing agent, the improvement wherein:

said coupler (a) comprises, in the coupling position, a carbamoyloxy group, and (b) upon oxidative coupling with the oxidized form of said reducing agent, releases a carbamic acid fragment that, in turn, is capable of thermally releasing ammonia or an amine.

8. A photothermographic element as in claim 7 wherein said coupler is a dye-forming coupler.

9. A photothermographic element as in claim 7 comprising a toner.

10. A photothermographic element as in claim 7 comprising a toner selected from the group consisting of phthalazinone, phthalazine, N-hydroxynaphthalimide and succinimide toners.

11. In a photothermographic element comprising a support bearing, in reactive association, in binder, (a) photographic silver halide, (b) an image-forming combination comprising (i) a silver behenate oxidizing agent, with (ii) a reducing agent for silver behenate;

(c) a toner; and (d) a coupler that is capable of oxidative coupling with the oxidized form of said reducing agent to form a dye;

the improvement wherein, said coupler consists essentially of 2-chloro-3-methyl-4-carbamoyloxy-6-(α-2,4-di-t-pentylphenoxybutyrylamido)phenol.

12. A photothermographic element as in claim 1 comprising an aromatic dialdehyde capable of reacting with ammonia or an amine from the carbamic acid fragment.

13. A photothermographic element as in claim 1 comprising o-phthalaldehyde capable of reacting with ammonia or an amine from the carbamic acid fragment.

14. A photothermographic element as in claim 1 comprising a reducible cobalt(III) complex containing releasable amine ligands.

15. A photothermographic element as in claim 1 comprising, in at least one operatively associated layer, said image-forming material which comprise an energy-activatable image precursor composition comprising at least one cobalt(III) complex having releasable amine ligands and an image-forming material which generates a dye image in response to the release of said ligands.

16. In a photothermographic composition comprising (a) photographic silver halide, (b) an image-forming combination comprising (i) an organic heavy metal salt oxidizing agent with (ii) an organic reducing agent for the organic heavy metal salt oxidizing agent, (c) a coupler that is capable of oxidative coupling with the oxidized form of said reducing agent;

the improvement wherein:

said coupler (a) comprises a coupler moiety containing, in the coupling position, a carbamoyloxy group, and (b) which, upon oxidative coupling with the oxidized form of said developing agent, releases a carbamic acid fragment that, in turn, is capable of thermally releasing ammonia or an amine.

17. A photothermographic composition as in claim 16 wherein said coupler is a dye-forming coupler.

18. A photothermographic composition as in claim 16 comprising a toner.

19. A photothermographic composition as in claim 16 comprising a toner selected from the group consisting of phthalazinone, phthalazine, N-hydroxynaphthalimide and succinimide toners.

20. In a photothermographic composition comprising
(a) photographic silver halide,
(b) an image-forming combination comprising
(i) a silver behenate oxidizing agent, with
(ii) a reducing agent for silver behenate,
(c) a toner; and
(d) a coupler that is capable of oxidative coupling with the oxidized form of said reducing agent to form a dye;
the improvement wherein:
said coupler consists essentially of 2-chloro-3-methyl-4-carbamoyloxy-6-(α-2,4-di-t-pentylphenoxybutyrylamido)phenol.

21. A photothermographic composition as in claim 16 comprising at least one image-forming material which generates a dye image in response to the presence of ammonia or an amine from the carbamic acid fragment.

22. A photothermographic composition as in claim 16 comprising an aromatic 1,2-dialdehyde capable of reacting with ammonia or an amine from the carbamic acid fragment.

23. A photothermographic composition as in claim 16 comprising o-phthalaldehyde capable of reacting with ammonia or an amine from the carbamic acid fragment.

24. A photothermographic composition as in claim 16 comprising a reducible cobalt(III) complex containing releasable amine ligands.

25. A photothermographic composition as in claim 16 comprising an energy-activatable image precursor composition comprising a least one cobalt(III) complex having releasable amine ligands and an image-forming material which generates a dye image in response to the release of said ligands.

26. A photothermographic assemblage comprising a support bearing, in reactive association,
(a) a photothermographic silver halide layer comprising
(i) photographic silver halide,
(ii) an image forming combination comprising a silver behenate oxidizing agent with a reducing agent for silver behenate, and
(iii) a carbamoyloxy substituted dye-forming coupler consisting essentially of 2-chloro-3-methyl-4-carbamoyloxy-6-(α-2,4-di-t-pentylphenoxybutyrylamido)phenol;
in a binder; and
(b) an image receiving layer which comprises, in a polysulfonamide binder, cobalt(III) amine complex and o-phthalaldehyde.

27. A photothermographic assemblage comprising a support bearing, in reactive association,
(a) a photothermographic silver halide layer comprising
(i) photographic silver halide,
(ii) an image-forming combination comprising (I) an organic heavy metal salt oxidizing agent with (II) an organic reducing agent for the heavy metal salt oxidizing agent, and
(iii) a dye-forming coupler which contains in the coupling position a carbamoyloxy group and which is capable of reacting with the oxidized form of the organic reducing agent to release a carbamic acid fragment that, in turn, is capable of thermally releasing ammonia or an amine;
in a binder; and
(b) an image receiving layer which is capable of forming a dye image in response to ammonia or an amine transferred from (a) to (b) upon thermal processing of the photothermographic assemblage.

28. A photothermographic assemblage as in claim 27 comprising a toner in (a).

29. A photothermographic assemblage as in claim 27 comprising a toner in (a) selected from the group consisting of phthalazinone, phthalazine, N-hydroxynaphthalimide and succinimide toners.

30. A photothermographic assemblage as in claim 27 wherein said image receiving layer is on a second support.

31. A photothermographic assemblage as in claim 27 comprising a support bearing, in reactive association,
(a) a photothermographic silver halide layer comprising
(i) photographic silver halide,
(ii) an image-forming combination comprising (I) a silver behenate oxidizing agent, with (II) a phenylenediamine reducing agent for silver behenate;
(iii) a toner; and
(iv) a dye-forming coupler consisting essentially of 2-chloro-3-methyl-4-carbamoyloxy-6-(α-2,4-di-t-pentylphenoxybutyrylamido)phenol;
in a binder; and
(b) an image receiving layer which is capable of forming a dye image in response to ammonia or an amine transferred from (a) to (b) upon thermal processing of the photothermographic assemblage and comprising, in a polysulfonanide binder, a cobalt(III) amine complex and o-phthaldehyde.

32. A process of developing an image in an exposed photothermographic element comprising a support, bearing, in reactive association, in binder, photographic silver halide, a silver halide developing agent, and a coupler that is capable of oxidative coupling with the oxidized form of said developing agent; wherein the coupler (a) comprises, in the coupling position, a carbamoyloxy group, and (b) upon oxidative coupling with the oxidized form of said developing agent, releases a carbamic acid fragment that, in turn, is capable of thermally releasing ammonia or an amine; and, wherein said photothermographic element comprises at least one image-forming material which generates a dye image in response to the presence of ammonia or an amine from the carbamic acid fragment; said process comprising heating said element to a temperature within the range of about 100° C. to about 180° C. until said image is developed.

33. A process of developing an image in an exposed photothermographic element comprising a support, bearing, in reactive association, in binder,
(a) photographic silver halide,
(b) an image-forming combination comprising
(i) an organic heavy metal salt oxidizing agent with
(ii) an organic reducing agent for the organic heavy metal salt oxidizing agent; and,
(c) a coupler that is capable of oxidative coupling with the oxidized form of said reducing agent, said coupler comprising, in the coupling position, a carbamoyloxy group, and that upon oxidative coupling with the oxidized form of said reducing agent, releases a carbamic acid fragment which, in turn, is capable of thermally releasing ammonia or an amine;

said process comprising heating said element to a temperature within the range of about 100° C. to about 180° C. until said image is developed.

34. A process of developing an image in an exposed photothermographic element comprising a support, bearing, in reactive association, in binder, (a) photographic silver halide;

(b) an image-forming combination comprising (i) a silver behenate oxidizing agent;

(ii) a reducing agent for silver behenate;

(c) a toner; and (d) a coupler that is capable of oxidative coupling with the oxidized form of said reducing agent to form a dye, wherein said coupler consists essentially of 2-chloro-3-methyl-4-carbamoyloxy-6-(α-2,4-di-t-pentylphenoxybutyrylamido)-phenol;

said process comprising heating said element to a temperature within the range of about 100° C. to about 180° C. until said image is developed.

* * * * *